US006364702B1

(12) United States Patent
Mochizuki et al.

(10) Patent No.: US 6,364,702 B1
(45) Date of Patent: Apr. 2, 2002

(54) ELECTRICAL CABLE CONNECTOR

(75) Inventors: Shoichi Mochizuki, Yamanashi; Shinichi Ikemoto, Tokyo, both of (JP)

(73) Assignee: KEL Corporation, Tokyo (JP)

( * ) Notice: Subject to any disclaimer, the term of this patent is extended or adjusted under 35 U.S.C. 154(b) by 0 days.

(21) Appl. No.: 09/372,026

(22) Filed: Aug. 11, 1999

(30) Foreign Application Priority Data

Aug. 28, 1998 (JP) ..... 10-242688

(51) Int. Cl.[7] ..... H01R 9/05
(52) U.S. Cl. ..... 439/579; 439/874; 439/499
(58) Field of Search ..... 439/492, 494, 439/497, 499, 579, 607, 874, 610

(56) References Cited

U.S. PATENT DOCUMENTS 4,605,276 A * 8/1986 Hasircoglu ..... 339/176
4,690,478 A * 9/1987 Rahrig et al. ..... 439/271
4,772,223 A * 9/1988 Yasumoto ..... 439/578
4,941,831 A * 7/1990 Tengler et al. ..... 439/63
5,437,562 A * 8/1995 Michael ..... 439/581
5,842,872 A * 12/1998 Hosler, Sr. et al. ..... 439/63
5,980,308 A * 11/1999 Hu et al. ..... 439/497
6,012,955 A * 1/2000 Shinchi ..... 439/874

* cited by examiner

*Primary Examiner*—Brian Sircus
*Assistant Examiner*—Thanh-Tam Le
(74) *Attorney, Agent, or Firm*—Robert W. J. Usher

(57) ABSTRACT

An electrical cable connector P comprises a plurality of contacts 40, which are aligned and retained in a retaining member 10, and each contact includes a cable connection portion 42. The core wires 51 of cables are soldered respectively onto the upper surfaces of the cable connection portions 42. The retaining member 10 includes a plurality of receiving grooves, which are formed in alignment in a plane to receive, align and retain the cable connection portions 42, respectively. When the cable connection portions 42 are received and retained in the receiving grooves, and when the core wires 51 are placed on the upper surfaces of the cable connection portions, respectively, the upper ends of the core wires 51 are positioned at a height which is above the plane in which the grooves are formed. Therefore, all the core wires 51 are heated and soldered simultaneously by pressing a pulse heater on the core wires.

11 Claims, 12 Drawing Sheets

ELECTRICAL CABLE CONNECTOR

FIELD OF THE INVENTION

The present invention relates to an electrical cable connector which is used for electrical connection of a cable and a circuit board, a cable and a cable, and so on.

BACKGROUND OF THE INVENTION

Such electrical cable connectors have been available in various types. All of such connectors are designed such that each of the contacts constituting a connector must be connected to a core wire of a respective cable. As conventional methods for connecting the contacts of the connector to the core wires of the cables, crimping, clamping, wire soldering, etc. are well known.

Connection by crimping is performed by enclosing a respective cable with the protruding ends of each contact. If such a crimping is to be applied in the cable connection of a multiple terminal connector, which comprises a plurality of contacts aligned in a housing, then it is difficult to make the pitch of the contact alignment substantially small to realize a miniaturized connector.

Connection by clamping is performed by lancing the insulation of the core wire of a cable with a clamping portion that is provided in a contact and by holding the core wire with the clamping portion. Because of the way clamping is performed, there is a concern that the core wire may be damaged or cut during the clamping. Especially, when contacts are provided at a relatively small pitch as in a miniaturized connector with multiple terminals which is offered by the latest technology, because the cables as well as the core wires to be connected are very thin, there is a high possibility that the core wires may be damaged or cut during the clamping.

On the other hand, connection by wire soldering is not prone to cause the above mentioned problems. However, soldering the core wires one by one costs a substantial production cost. Especially, as the multi-terminalization of connectors progresses, the contact alignment pitch will become even smaller, so not only the production cost (labor hours) but also requirements for precision and reliability in the soldering are expected to increase further.

SUMMARY OF THE INVENTION

It is an object of the present invention to provide an electrical cable connector whose construction enables soldering of a plurality of contacts to the core wires of a plurality of cables in a single soldering step.

It is another object of the present invention to provide an electrical cable connector which is easy to perform the above mentioned soldering process and which offers a high reliability for the soldering connection.

It is yet another object of the present invention to provide an electrical cable connector which is suitable for connection of a plurality of coaxial cables.

It is still another object of the present invention to provide an electrical cable connector whose construction enables electrical grounding of the shielding layers of a plurality of coaxial cables in a lump.

To achieve these objectives, an electrical cable connector according to the present invention comprises a plurality of contacts, which are aligned and retained in a retaining member made of an electrically insulative material. Each of the contacts includes a cable connection portion with an upper surface, onto which a core wire of each cable is soldered. The retaining member includes a plurality of receiving grooves, which are provided in alignment in a plane to receive, align and retain the cable connection portions of the contacts, respectively. When the cable connection portions of the contacts are received and retained in the receiving grooves, and when the core wires are mounted on the upper surfaces of the cable connection portions, respectively, the upper ends of the core wires are positioned evenly above the plane in which the receiving grooves are provided.

In this cable connector, the upper ends of all the core wires, which are placed on the cable connection portions that are retained in the receiving grooves, respectively, are positioned evenly. Therefore, by bringing the heating surface of a pulse heater into contact to heat the core wires, all the core wires are soldered in a single soldering step to the cable connection portions of the contacts, respectively.

Preferably, all of the receiving grooves have an identical depth which is greater than the thickness of the cable connection portions. As a result, when the cable connection portions are received and retained in the receiving grooves, the upper surfaces of the cable connection portions are positioned below the surfaces of the receiving grooves (i.e., below the plane in which the receiving grooves are provided). Thus, the core wires are placed respectively in the concaves which are defined by the sides of the receiving grooves and the upper surfaces of the cable connection portions. This construction makes the placing and positioning of the core wires simple and precise.

The above mentioned cables can be coaxial cables, each comprising a core wire, an inner insulating layer, which covers the core wire, an electrically conductive shielding layer, which covers the inner insulating layer, and an outer insulating layer, which covers the electrically conductive shielding layer. In this case, a plurality of coaxial cables are stripped of the outer insulating layers to expose the electrically conductive shielding layers and are aligned to one another. Then, by sandwiching the exposed electrically conductive shielding layers with two electrically conductive binding plates, these coaxial cables are aligned and retained in a plane. In this condition, the core wires, which are aligned and are exposed at the end portions of the coaxial cables beyond the portions that are sandwiched by the electrically conductive binding plates, are placed and then soldered in a single soldering step easily and precisely onto the upper surfaces of the cable connection portions, which are retained in the receiving grooves.

Preferably, the portions of the coaxial cables between the portions where the core wires are exposed and the portions which are sandwiched by the electrically conductive binding plates are stripped of the outer insulating layers and of the electrically conductive shielding layers to expose the inner insulating layers, and these portions, where the inner insulating layers are exposed, are bent in a U or V shape to provide slacks. This construction prevents any external force acting on the cables from accidentally affecting the soldered portions between the core wires and the cable connection portions because such external forces can be cushioned by these slacks. Also, this construction can effectively prevents any external force which may be created from displacement of the electrically conductive binding plates from affecting the soldered portions because the slacks can absorb such displacement.

In addition, this cable connector is provided with a metallic cover to cover the retaining member and the electrically conductive binding plates. Preferably, the electrically conductive binding plates are maintained in contact with the metallic cover to establish an electrical connection. Furthermore, when this connector is engaged with an matable connector, the metallic cover comes into contact with a grounding member which is provided in the matable connector. Thereby, an electrical grounding connection is established when the connectors are engaged. In this construction, the electrically conductive binding plates are fixed and retained in the cover to prevent any external force from accidentally affecting the soldered portions between the core wires and the cable connection portions, and the shielding layers of the cables are grounded electrically through the electrically conductive binding plates and the metallic cover.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
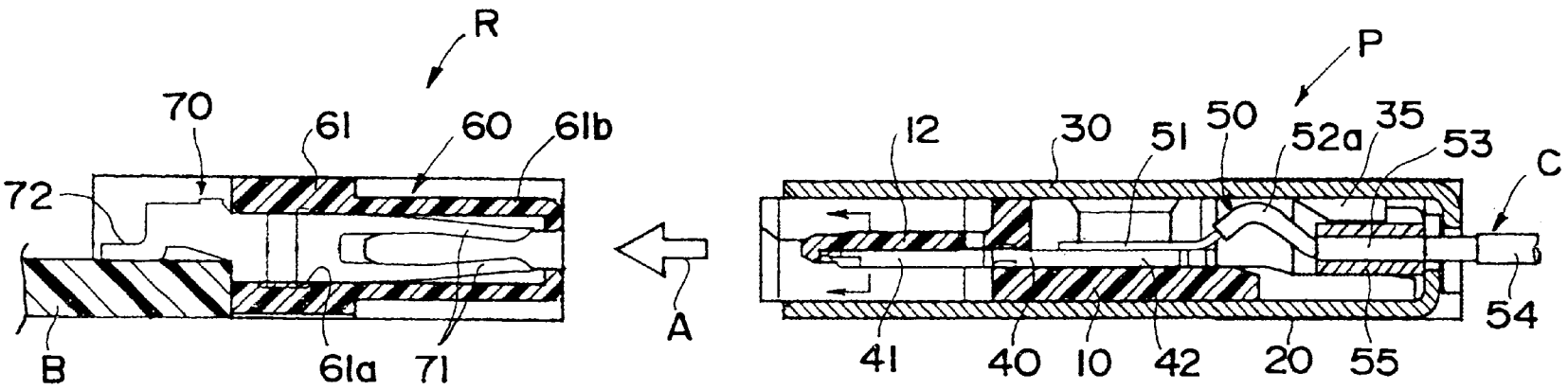
FIG. 1 shows a cross-sectional view of a plug connector half (referred to as "plug connector"), which constitutes an electrical cable connector according to the present invention, and a receptacle connector half (referred to as "receptacle connector"), which is matable with the plug connector, taken along line I—I in FIG. 2 and also line I—I in FIG. 15.
Figure 2:
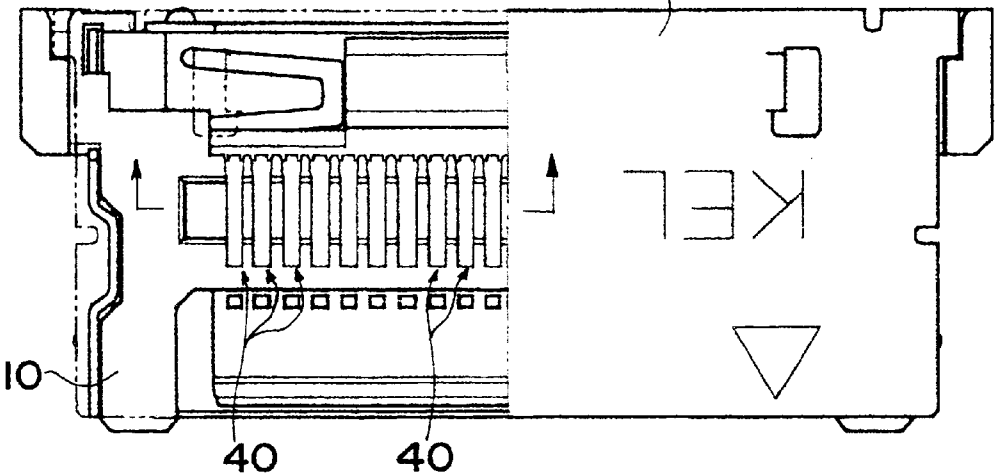
FIG. 2 shows a partially cut away plan view and a front view of the plug connector.
Figure 2:
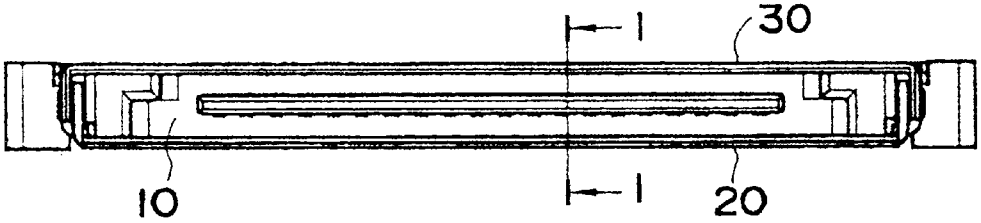
Figure 15:
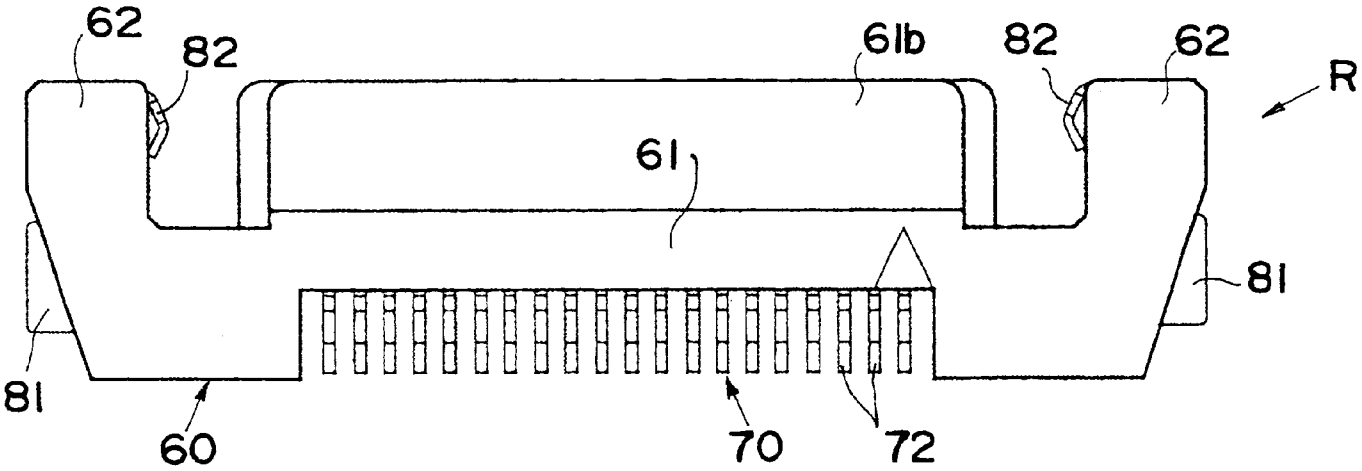
FIG. 15 shows a plan view and a front view of the receptacle connector.
Figure 15:
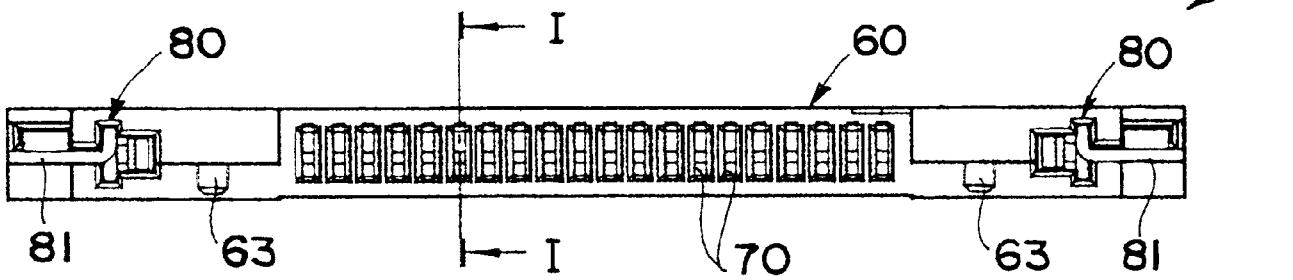
Figure 16:
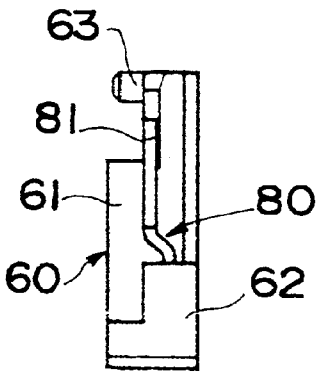
FIG. 16 shows a bottom view, a back view and a side view of the receptacle connector.
Figure 16:
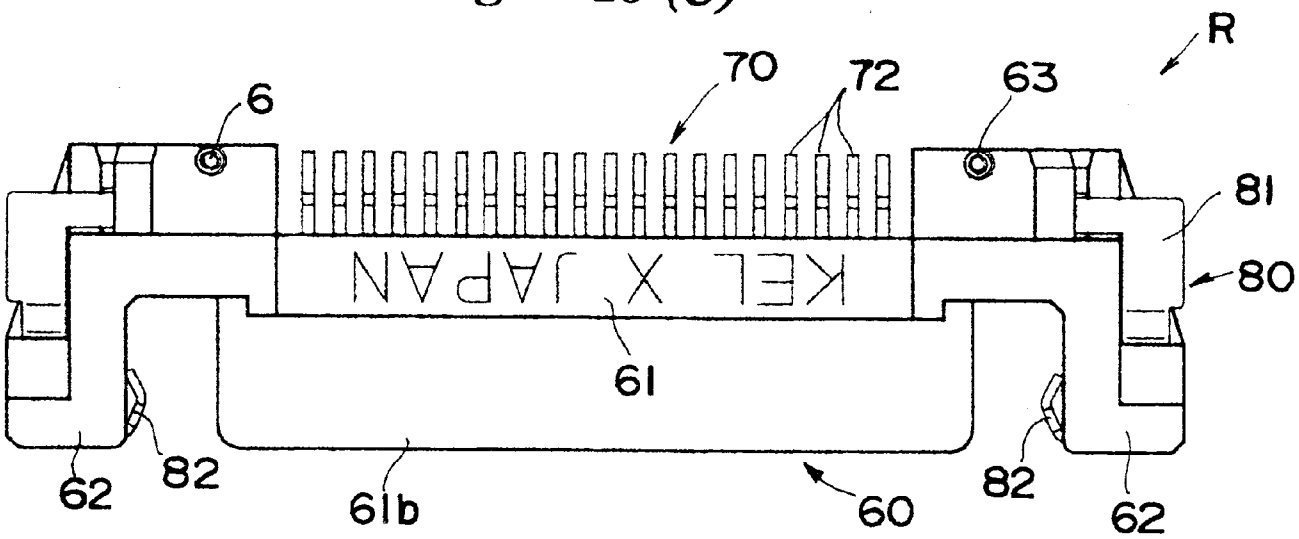
Figure 16:
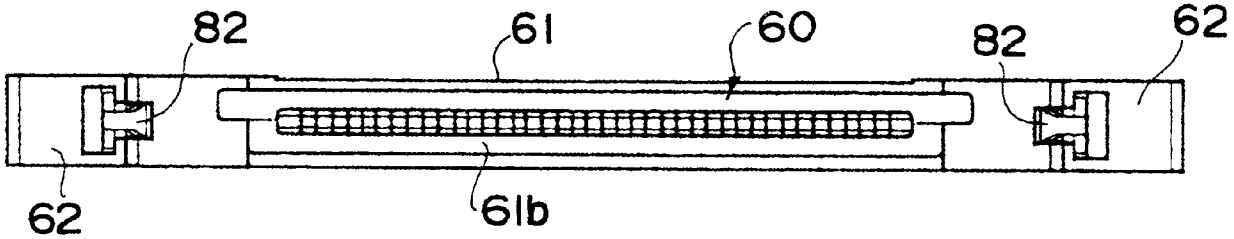

FIG. 1 shows a plug connector P and a receptacle connector R, which are matable with each other. Here, the plug connector P constitutes an electrical cable connector according to the present invention. Also, FIG. 2 shows the plug connector P, and FIGS. 15 and 16 show the receptacle connector R. FIG. 1 is a cross-sectional view taken along line I—I in FIG. 2 and also along line I—I in FIG. 15.

The plug connector P comprises metallic lower and upper covers 20 and 30, a plug retaining member 10, which is formed of an electrically insulative resin and placed between the two covers 20 and 30, a plurality of plug contacts 40, which are aligned to one another on a plane and retained in the plug retaining member 10, and a cable assembly C, whose cables are soldered to the plug contacts 40 respectively and extend outward from the rear end of the plug contacts 40.

Figure 3:
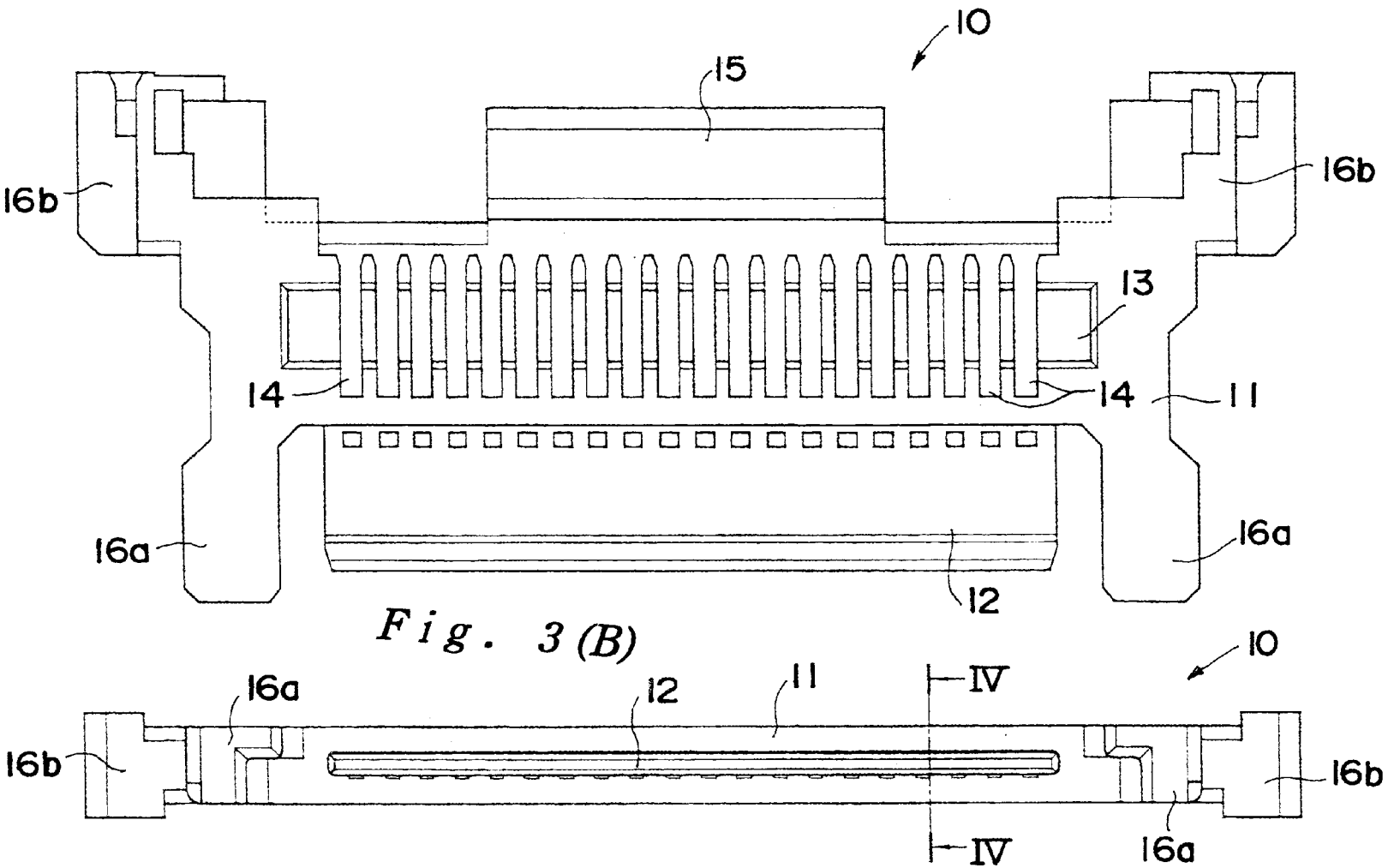
FIG. 3 shows a plan view and a front view of a retaining member of the plug connector (referred to as "plug retaining member")
Figure 4:
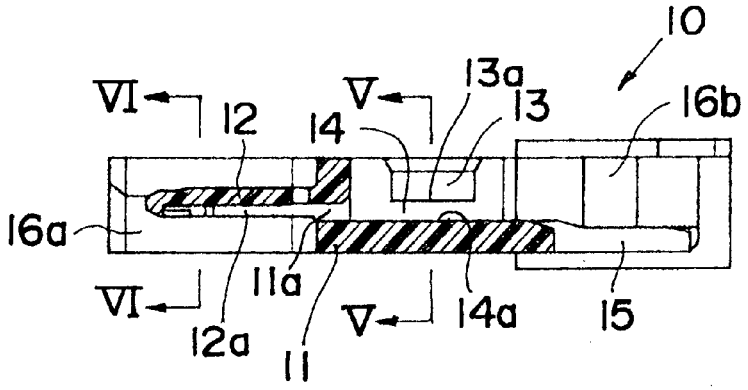
FIG. 4 shows a sectional view of the plug retaining member, taken along line IV—IV in FIG. 3.
Figure 5:
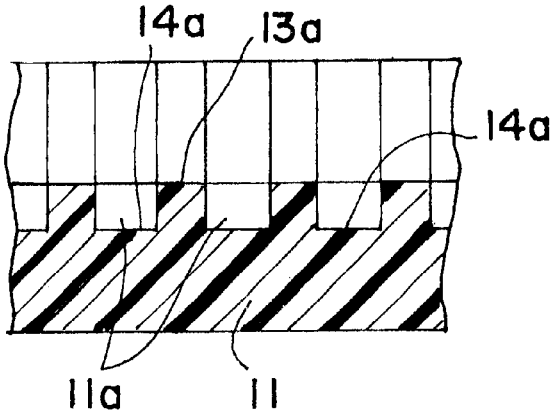
FIG. 5 shows a sectional view of the plug retaining member, taken along line V—V in FIG. 4.
Figure 6:
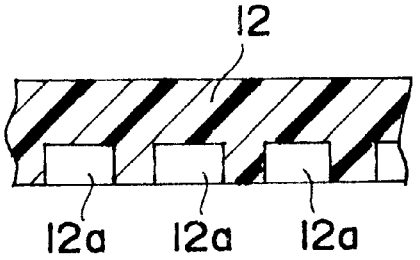
FIG. 6 shows a sectional view of the plug retaining member, taken along line VI—VI in FIG. 4.

The plug retaining member 10 is formed by molding as a one body including a main body 11, right and left front protrusions 16*a*, each of which extends forward from a front end on the lateral sides, and right and left rear protrusions 16*b*, each of which extends backward from a rear end on the lateral sides as shown in FIGS. 3 and 4. In addition, the plug retaining member 10 is formed with a plate-like plug extrusion 12, which extends forward from the main body 11 between the right and left front protrusions 16*a*, and with a central extrusion 15, which extends backward from the lower central portion of the main body 11 between the right and left rear protrusions 16*b*. A central groove 13 is provided extending laterally in the upper face of the main body 11, and a plurality of slots 14 are provided extending axially (i.e., in the direction of the axis of symmetry) across the central groove 13. FIG. 5 shows a sectional view of this part of the main body 11, taken along line V—V in FIG. 4. The plurality of slots 14 are deeper than the central groove 13, and the slot bottoms 14*a* of the slots 14 are positioned below the groove bottom 13*a* of the central groove 13. Therefore, in the central groove 13, the groove bottom 13*a* is the surface from which the slots 14 are guttered. Furthermore, the slot bottoms 14*a* are continuous to the bottom surfaces of through-holes 11*a* which are provided passing through the main body 11 to the plug extrusion 12. As shown in FIG. 6, which is a sectional view taken along line VI—VI in FIG. 4, the through-holes 11*a* are continuous to slots 12*a*, respectively, which are provided in the lower side of the plug extrusion 12.

Figure 11:
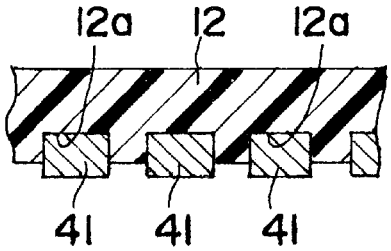
FIG. 11 shows a sectional view taken along line XI—XI in FIG. 9.

It is clear from the drawing that the slots 14, the through-holes 11*a* and the slots 12*a* are continuous, respectively, in the axial direction, and these axially continuous slots, which are used for insertion of electrical contacts (each slot is referred to as "contact insertion slot"), are aligned laterally. Each of the plug contacts 40 is press-fit from the rear of the main body 11 into a respective contact insertion slot, so a male contact portion 41, which is the front end portion of each plug contact 40, is received and retained in a respective slot 12*a* while a connection portion 42, which is the rear end portion of each plug contact 40, is received and retained in a respective slot 14 (for example, refer to FIGS. 1 and 9). As shown in FIG. 11, the male contact portions 41 are received and retained in the slots 12*a* of the plug extrusion 12, so the plug extrusion 12 serves to support and reinforce the male contact portions 41.

Figure 7C:
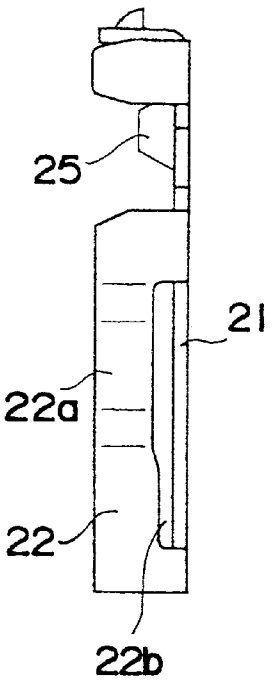
FIG. 7 shows a plan view, a front view and a side view of a lower cover.
Figure 7A:
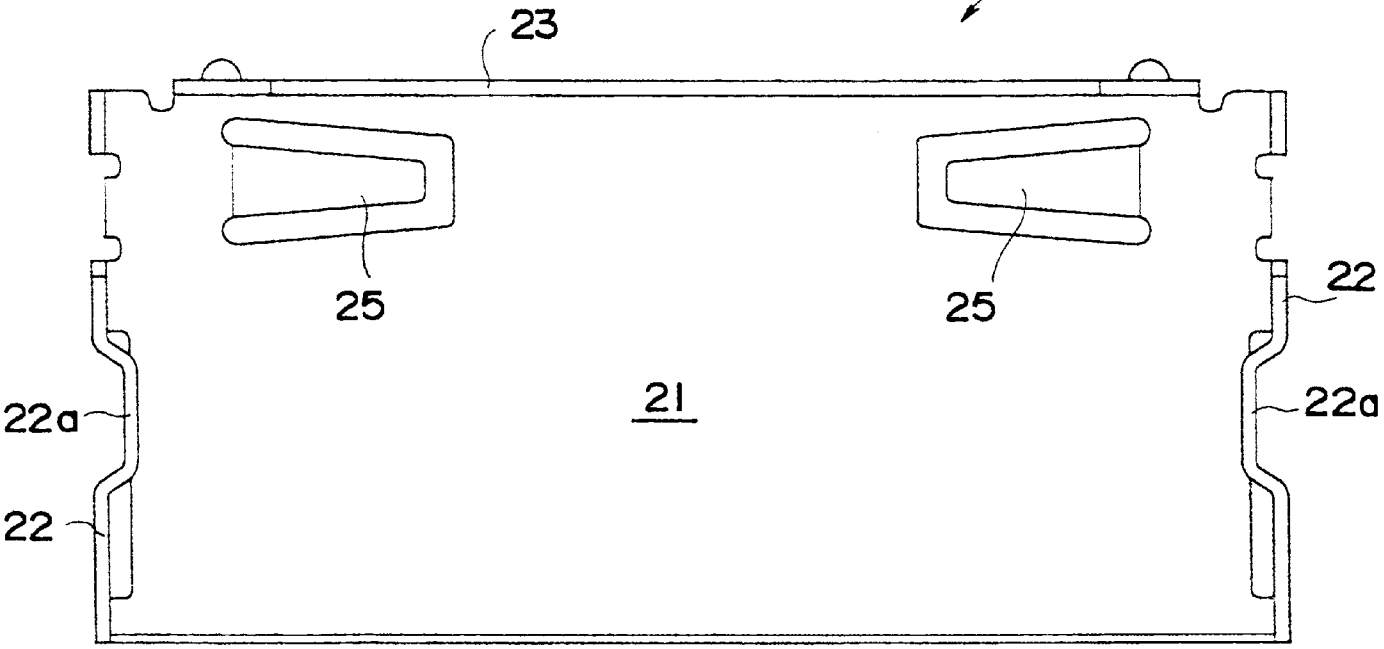
Figure 7B:
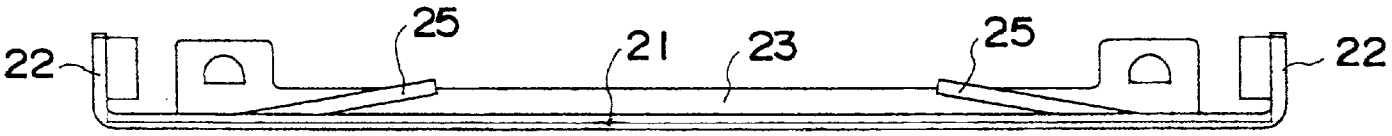
Figure 8:
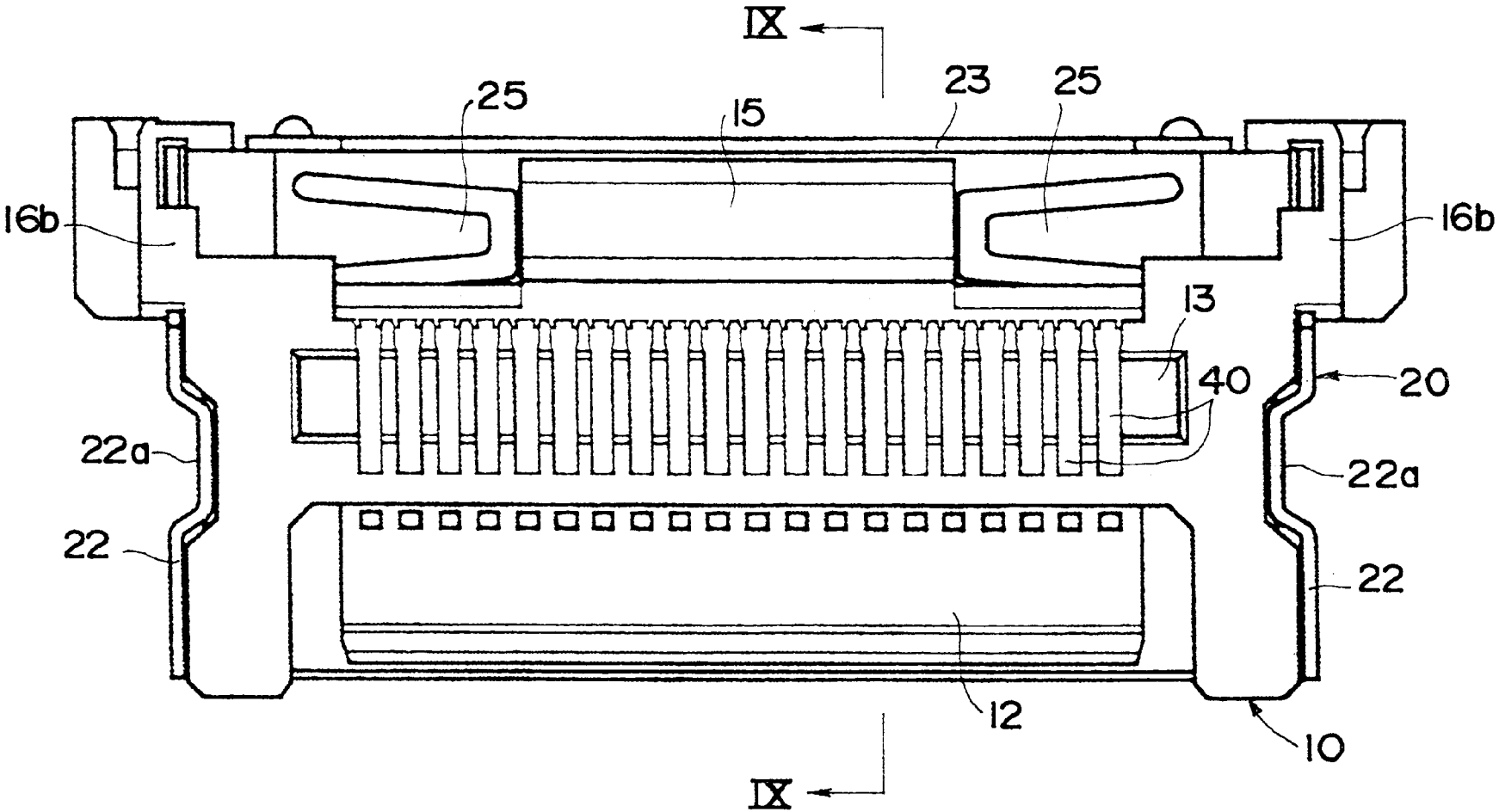
FIG. 8 shows a plan view showing the plug retaining member being mounted in the lower cover.

As shown in FIG. 8, this plug retaining member 10 (i.e., the plug retaining member 10 with the plug contacts 40 press-fit therein) is then mounted in the lower cover 20, which is also shown in detail in FIG. 7. The lower cover 20 comprises a rectangular flat bottom portion 21, lateral side walls 22 and a rear wall 23, each of which is bent upward from the bottom portion 21. Each lateral side wall 22 includes a concave portion 22*a*, which is recessed inward, and an engagement slot 22*b*, which extends axially on the lower side. When the plug retaining member 10 is being mounted into the cover, the plug retaining member 10 fits to the lateral side walls 22 and the rear wall 23 because each side of the plug retaining member 10 meets a respective concave portion 22*a*, which functions as a positioning guide.

The bottom portion 21 includes a lateral pair of contact tabs 25, which are formed by incising the rear part of the bottom portion 21 on the right and left sides and by bending the incised portions upward as shown in FIG. 7. When the plug retaining member 10 is mounted in the lower cover 20, each of the contact tabs 25 is positioned between the central extrusion 15 and the right or left rear protrusion 16*b* of the plug retaining member 10 as shown in FIG. 8, and the ends of the contact tabs 25 are above the upper surface of the central extrusion 15. The front of the lower cover 20 is open, so the plug extrusion 12 are exposed forward.

Figure 9:
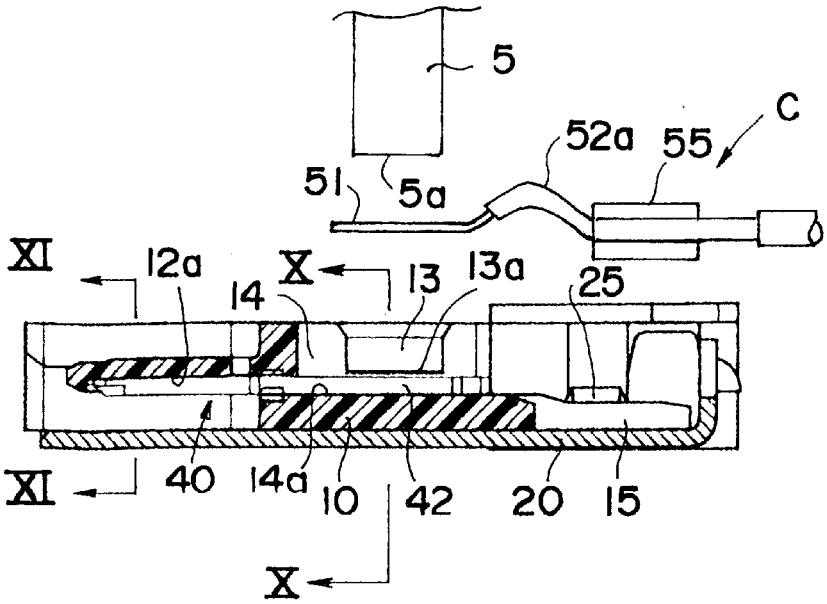
FIG. 9 shows a sectional view taken along line IX—IX in FIG. 8.
Figure 12:
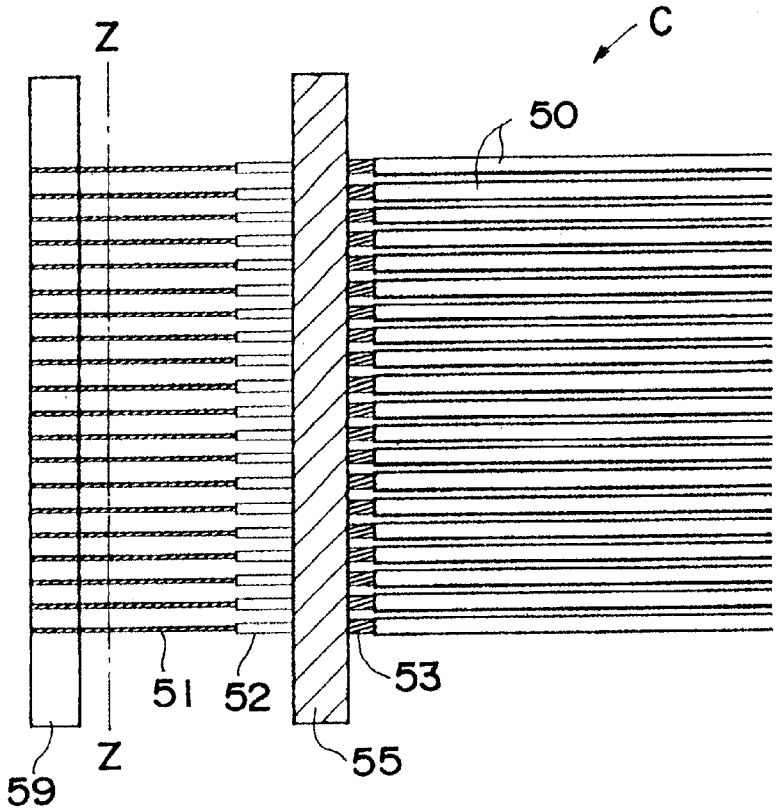
FIG. 12 shows a plan view, a front view and a side view of a cable assembly.
Figure 12:
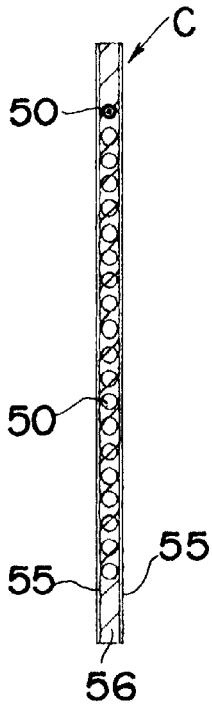
Figure 12:
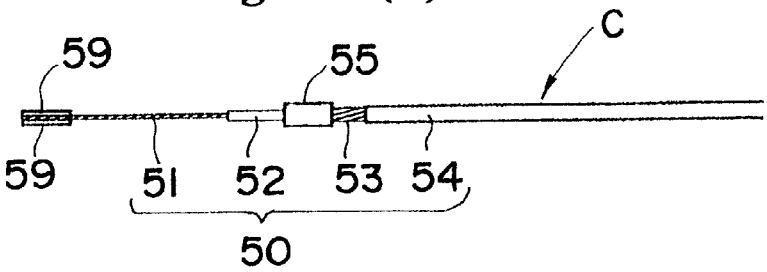

FIG. 9 shows the condition of the plug connector in which the plug retaining member 10 is mounted in the lower cover 20 in a sectional view taken along line IX—IX in FIG. 8. Now, the cable assembly C, which is shown in detail in FIG. 12, is connected to the connection portions 42 of the plug contacts 40 by soldering. The cable assembly C comprises a plurality of coaxial cables 50, which are aligned on a plane and are sandwiched between a pair of upper and lower binding plates 55.

Figure 13:
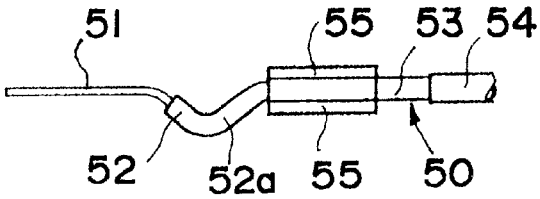
FIG. 13 shows a plan view and an enlarged sectional view of an end portion of the cable assembly.
Figure 13:
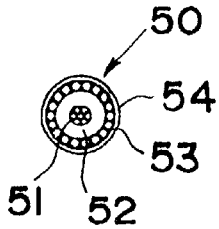

As shown in FIG. 13 (B), each of the coaxial cables 50 comprises an inner conductor (or core wire) 51, which is positioned centrally, an inner insulating layer 52, which surrounds the core wire 51, a braided outer conductor (or shielding layer) 53, which surrounds the inner insulating layer 52, and an outer insulating layer 54, which covers the shielding layer 53. The cable assembly C is assembled by stripping respective layers of each coaxial cable 50 in a stair fashion, by aligning the coaxial cables 50 on a plane, by sandwiching the portions of the coaxial cables 50 where the shielding layers 53 are exposed with the binding plates 55 and by soldering them with a solder 56. Furthermore, the core wires 51, which are positioned at the front end of the cable assembly C, are coated with the solder. Moreover, the front ends of the core wires 51 are sandwiched with laminated films 59 to prevent deformation of the core wires 51 for the purpose of maintaining their relative positions intact. Before the cable assembly C is soldered to the plug connector, the end portions of the core wires 51 are cut away at the position indicated by a chain line Z—Z in the drawing. As shown in FIG. 13 (A), the portions where the inner insulating layers 52 are exposed are bent in a U or V shape so that the coaxial cables are provided with slacks 52*a*.

The cable assembly C, which is assembled as described above and removed of the front end portions of the core wires 51 after being cut at the chain line Z—Z, is now soldered to the plug connector by a pulse heater, as shown in FIG. 9. In this soldering process, at first, the core wires 51, which are exposed at the front end of the cable assembly C, are mounted on the connection portions 42 of the plug contacts 40, which are retained in the plug retaining member 10 (refer to FIG. 10, which shows a sectional view taken along line X—X).

Figure 10:
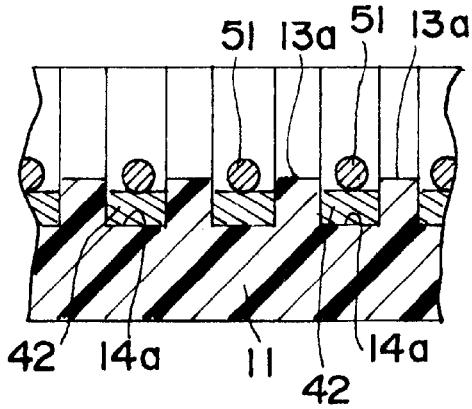
FIG. 10 shows a sectional view taken along line X—X in FIG. 9.

As mentioned previously, the connection portions 42 of the plug contacts 40 are press-fit in the slots 14 of the plug retaining member 10. In this condition, the depth of the slots 14 (i.e., the vertical dimension from an upper end of the slot 14 or from the groove bottom 13*a* of the central groove 13 to the slot bottom 14*a* of the slot 14 ) is greater than the vertical thickness of the connection portions 42 of the contacts, so the upper surfaces of the connection portions 42 are positioned below the groove bottom 13*a* of the central groove 13. As a result, groove concaves opening upward are formed by the sides of the slots 14 and the upper surfaces of the connection portions 42 as shown in FIG. 10. The core wires 51 are placed into these groove concaves precisely. When the core wires 51 are mounted on the connection portions 42 of the contacts, because the difference between the depth of the slots 14 and the vertical thickness of the connection portions 42 is smaller than the diameter of the core wires 51, the upper tips of the core wires 51 are positioned above the groove bottom 13*a* of the central groove 13 as shown in FIG. 10.

In this condition, where the core wires 51 are mounted on the connection portions 42 of the contacts, the lower surface 5*a* of a heater chip 5 of the pulse heater is lowered and pressed on the core wires 51 to heat the core wires 51 with the heater chip 5 so as to melt the solder coating, which is provided over the core wires 51, and to solder the core wires 51 to the connection portions 42. For this soldering process, the heater chip 5 is designed with a flat lower surface 5*a* which is insertable into the central groove 13 of the plug retaining member 10. Therefore, the lower surface 5*a* is pressed directly onto the core wires 51 only by inserting the heater chip 5 into the central groove 13. This is a simple way which enables the soldering of all the core wires 51 in a single soldering step.

Then, the binding plates 55 of the cable assembly C, whose core wires 51 are soldered to the connection portions 42 of the contacts, are positioned in the rear part of the plug retaining member 10. In other words, the binding plates 55 are mounted over the contact tabs 25 of the lower cover 20 and the central extrusion 15 of the plug retaining member 10, which is in the lower cover 20. In this condition, the binding plates 55 are in contact with the contact tabs 25.

Figure 14:
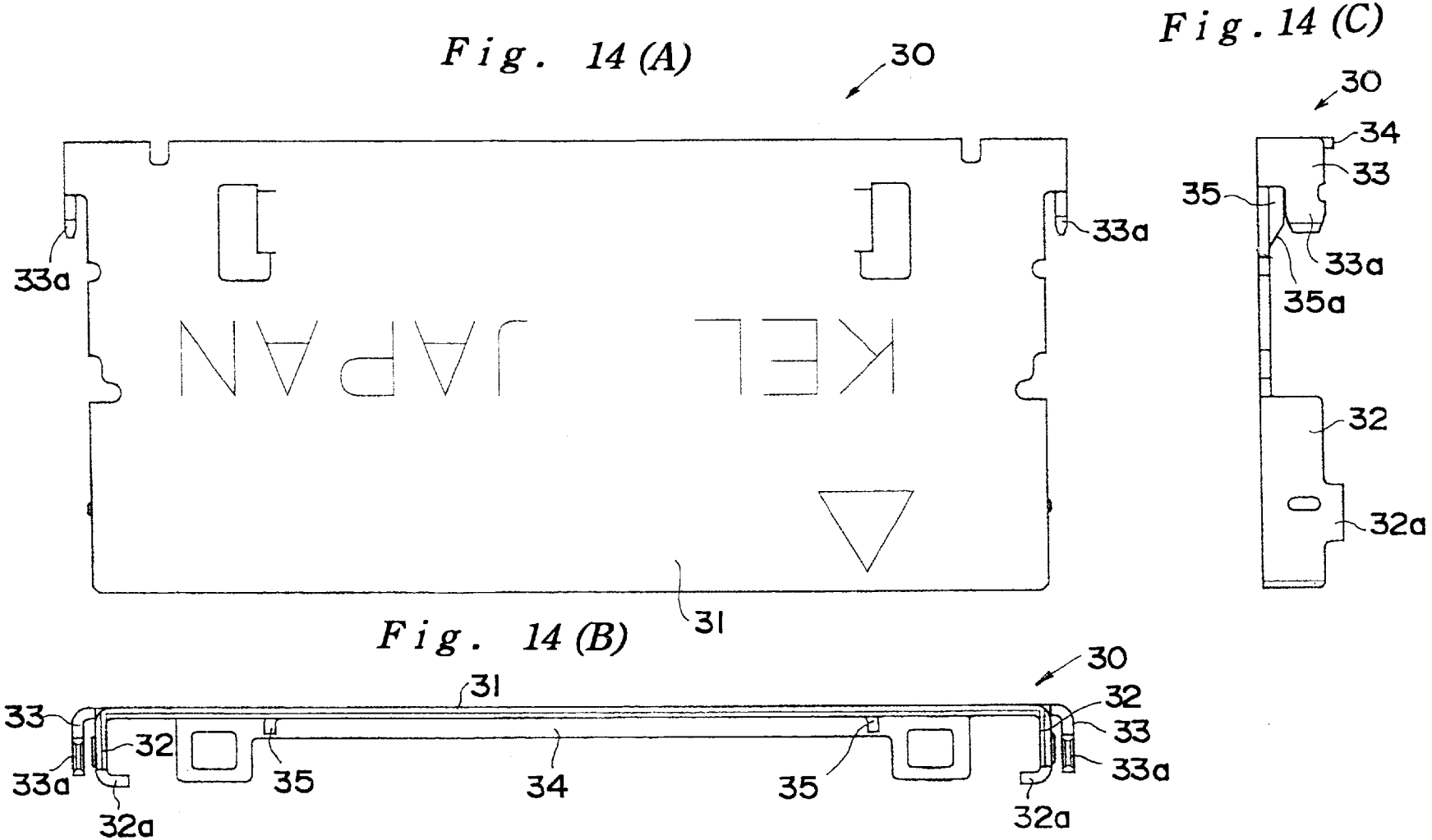
FIG. 14 shows a plan view, a front view and a side view of an upper cover.

Now, the upper cover 30, which is shown in FIG. 14, is mounted. The upper cover 30 comprises a rectangular flat top portion 31, lateral front side walls 32, rear side walls 33 and a rear wall 34, each of which is bent downward from the top portion 31. Each front side wall 32 includes an engaging portion 32*a*, which is bent inward, and each rear side wall 33 includes an engaging protrusion 33*a*, which protrudes forward. The top portion 31 includes a lateral pair of pressing protrusions 35, which are formed by incising the rear part of the top portion 31 on the right and left sides and by bending the incised portions downward as shown in the drawing. Each pressing protrusion 35 has a taper 35*a* at the front end thereof, which taper is designed to increase the height of the pressing protrusions 35 gradually toward the rear.

This upper cover 30 is placed on the lower cover 20 (which includes the plug retaining member 10 and the cable assembly C) with the front side walls 32 being placed outside the concave portions 22*a* of the lower cover 20, and the upper cover is then slid forward. As a result, the engaging portions 32*a* of the front side walls 32 enter the engagement slots 22*b* of the lateral side walls 22 of the lower cover 20 shown in FIG. 7, so the lower and upper covers 20 and 30 are engaged firmly with each other. At the same time, the engaging protrusions 33*a* of the rear side walls 33 enter the engaging slots (not shown) which are provided in the rear of the plug retaining member 10, so the upper cover 30 and the plug retaining member 10 are also engaged with each other. At this moment, the pressing protrusions 35 being led by the tapers 35*a* come onto the binding plates 55 and press the binding plates 55 downward. In this condition, the binding plates 55 is securely in contact with the pressing protrusions 35 and with the contact tabs 25 of the lower cover 20.

In this way, the plug connector is assembled with the binding plates 55 fixedly retained in the lower and upper covers 20 and 30. In this assembled condition, the slacks 52*a* of the cable assembly C are located between the binding plates 55 and the exposed core wires 51, which are soldered. This condition prevents any external force acting on the cable assembly C from accidentally affecting the electrical connection of the core wires 51 because such external forces are blocked by the binding plates 55 or absorbed by the slacks 52*a*. Therefore, this plug connector offers a high reliability avoiding any connection failure at the soldered parts.

On the other hand, the receptacle connector R, whose exterior appearance is shown in FIGS. 15 and 16, comprises a plurality of electrically conductive receptacle contacts 70, which are press-fit and aligned in an electrically insulative receptacle retaining member 60 as shown in FIG. 1, which is a sectional view taken along line I—I in FIG. 15. Each receptacle contact 70 has a female contact portion 71, which is shaped like a tuning fork, and a rear lead portion 72, which is used for surface mounting.

The receptacle retaining member 60 is formed by molding as a one body including a main body 61, arms 62, which are provided on the right and left sides of the main body 61, and a central protrusion 61*b*, which extends forward between the right and left arms 62. A plurality of insertion slots 61*a* are provided laterally in the main body 61 to receive and retain the receptacle contacts 70, which are press-fit into the slots, and the insertion slots 61*a* are open at the front end of the central protrusion 61*b*. Therefore, the female contact portions 71 of the receptacle contacts 70 in the insertion slots 61*a* of the main body 61 face the outside through the openings of the central protrusion 61*b* while the lead portions 72 of the receptacle contacts 70 extend in the opposite direction to the outside of the main body 61. An electrically grounding member 80 is provided fittingly in each arm 62, and this grounding member 80 comprises a grounding contact portion 82, which extends from the inside of a respective arm 62 toward the central protrusion 61*b*, and a mounting portion 81, which protrudes rearward from the arm 62. The lower faces of the mounting portions 81 are positioned at the same level as the lower faces of the lead portions 72 of the receptacle contacts 70.

A pair of positioning pins 63 are provided on the rear lower face of the receptacle retaining member 60. These positioning pins 63 are used to position the receptacle connector R on a printed circuit board B as shown in FIG. 1. When the receptacle connector R is mounted on the printed circuit board B, the lower faces of the lead portions 72 of the receptacle contacts 70 and the lower faces of the mounting portions 81 of the grounding members 80 are surface-mounted on electrical pathways which are provided on the printed circuit board B for signal transmission and for grounding, respectively.

The plug connector P and the receptacle connector R, both of which are constructed as described above, are engaged with each other for electrical connection in the direction indicated by an arrow A in FIG. 1. When they are brought into engagement, the plug extrusion 12 retaining the male contact portions 41 of the plug contacts 40 in the slots 12*a* of the plug connector P is inserted into the female contact portions 71 of the receptacle contacts 70 of the receptacle connector R. As a result, the female contact portions 71 hold the plug extrusion 12 together with the male contact portions 41, so the female contact portions 71 and the male contact portions 41 are in contact with each other, establishing the electrical connection between the plug contacts 40 and the receptacle contacts 70. There is no possibility of deformation of the plug contacts 40 during the engagement even though they are thin members because the plug contacts 40 are supported and strengthened by the plate-like plug extrusion 12 and inserted together with the plug extrusion 12 into the female contact portions 71.

Furthermore, when both the connectors P and R are intermated, the right and left front protrusions 16*a* of the plug retaining member 10, which are surrounded by the lower and upper covers 20 and 30 of the plug connector P, are inserted into the spaces located between the right or left arm 62 and the central protrusion 61*b* of the receptacle connector R, respectively, and the external surfaces of the sides of the upper cover 30 of the plug connector P are brought into contact with the grounding contact portions 82 of the grounding members 80 of the receptacle connector R. In this condition, the lower and upper covers 20 and 30 are grounded electrically because the mounting portions 81 of the grounding members 80 are surface-mounted on the grounding pathways of the printed circuit board B. Also, the shielding layer 53 of each coaxial cable 50 is grounded electrically as the binding plates 55 of the cable assembly C are held by and are in contact with the lower and upper covers 20 and 30.

Figure 17:
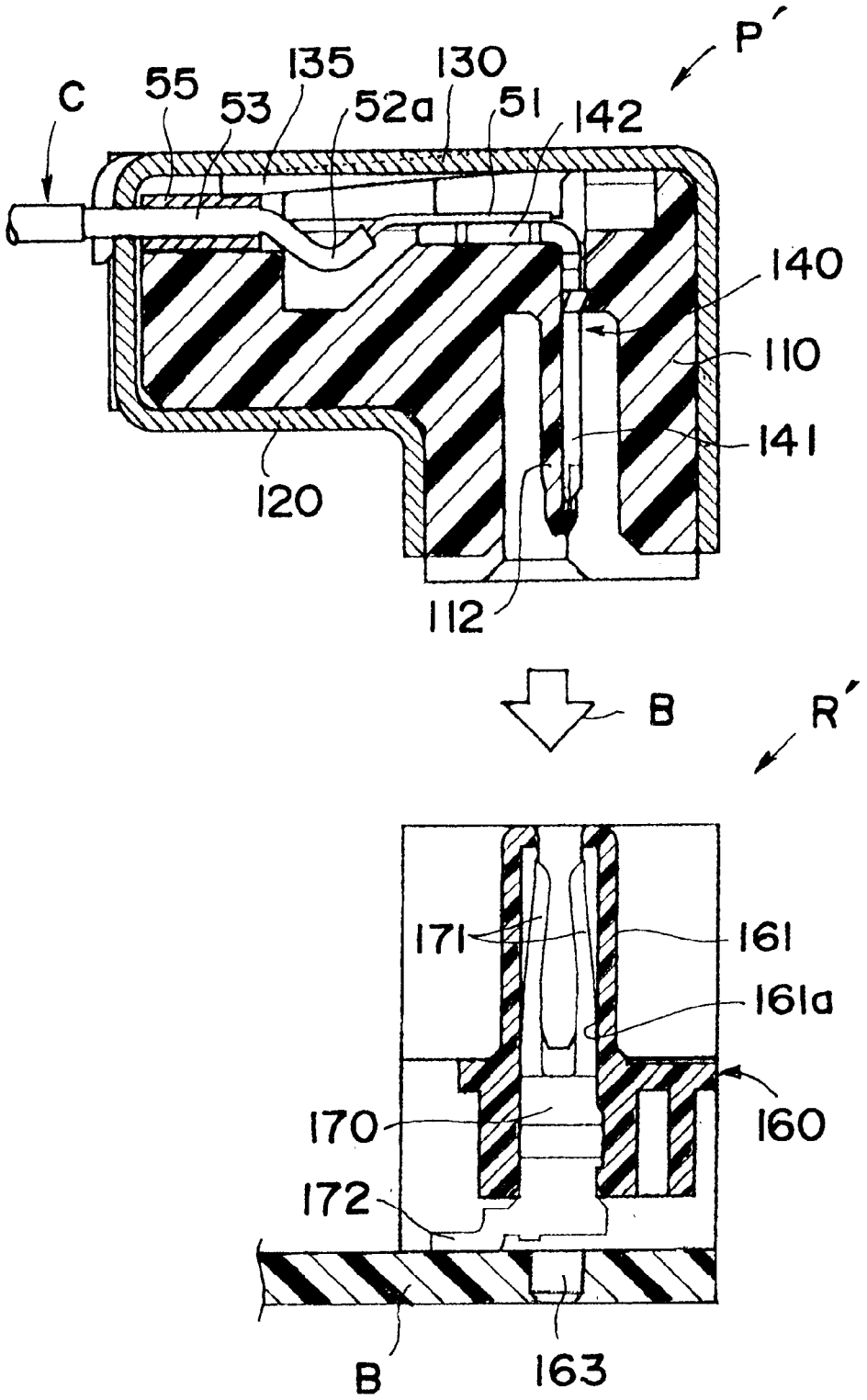
FIG. 17 shows a cross-sectional view of a plug connector and a receptacle connector, which plug connector constitutes another embodiment of cable connector according to the present invention.

The cable connector according to the present invention is not limited to the above mentioned embodiment. For example, the present invention can be also embodied in such a construction as shown in FIG. 17. This connector assembly comprises a right-angle type plug connector P' and a receptacle connector R', which is mountable on the printed circuit board B in a upright position. These plug and receptacle connectors are matable with each other in the direction indicated by an arrow B.

The plug connector P' comprises a plurality of plug contacts 140, a plug retaining member 110, which is made of an electrically insulative material and which retains the plug contacts 140 in a lateral alignment, and lower and upper covers 120 and 130, which are made of an electrically conductive material. Each plug contact 140 is bent in a L shape and comprises a male contact portion 141 in the front end thereof and a connection portion 142 in the rear end thereof. The plug retaining member 110 includes a plug extrusion 112, which has an identical construction as the above mentioned embodiment (shown in FIG. 1 through FIG. 16). The plug extrusion 112 receives and retains the male contact portions 141 of the plug contacts 140, which are press-fit into the respective slots of the plug retaining member 110.

The core wires 51 of the cable assembly C are soldered to the connection portions 142, respectively. This soldering connection is rendered in the same way as in the above mentioned embodiment. The core wires 51, which are soldered to the plug contacts 140, the slacks 52*a* and the binding plates 55, which are provided in the cable assembly C, are covered with the lower and upper covers 120 and 130. In this condition, the pressing protrusions 135 of the upper cover 130 are in contact with the binding plates 55.

The receptacle connector R' comprises a plurality of receptacle contacts 170, which are made of an electrically conductive material, and a receptacle retaining member 160, which is made of an electrically insulative material. Each contact 170, which has a shape of tuning fork, comprises a bifurcated female contact portion 171 at the front end thereof and a lead portion 172 at the rear end. The receptacle contacts 170 are press-fit into the insertion slots 161*a* of the receptacle retaining member 160 and aligned and retained in the receptacle retaining member 160. In this condition, the female contact portions 171 of the receptacle contacts 170 face the outside through the openings of the insertion slots 161*a*, which openings are provided at the front end of the central protrusion 161, and the lead portions 172 are surface-mounted on respective electrical pathways which are provided for signal transmission on the printed circuit board B. To position the receptacle connector R' on the printed circuit board B for this surface-mounting, the positioning pins 163 of the receptacle retaining member 160 are inserted into the positioning holes of the printed circuit board B.

Though the following description is not illustrated in figures, the receptacle connector R' further comprises lateral arms, which include a pair of grounding members constructed similarly to those of the receptacle connector R, which are shown in FIGS. 15 and 16. Therefore, when the plug and receptacle connectors P' and R' are engaged with each other in the direction indicated by an arrow B in the drawing, the male contact portions 141, which are retained and strengthened by the plug extrusion 112, are inserted into and held in the female contact portions 171 of the receptacle contacts 170 together with the plug extrusion 112. As a result, the male contact portions 141 are in contact with the female contact portions 171, establishing the electrical connection between the plug contacts 140 and the receptacle contacts 170. In this condition, the external surfaces of the sides of the lower and upper covers 120 and 130 are in contact with the grounding members, which are provided in the arms of the receptacle connector R', so the shielding layers 53 of the cable assembly C are grounded electrically through the binding plates 55, which are in contact with the lower and upper covers 120 and 130.

The fitting portions of the plug connectors P and P' and the receptacle connectors R and R', which are constructed as described above, are configured in identical shapes with identical dimensions, respectively, so they can be mated interchangeably.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 10-242688 filed on Aug. 28, 1998, which is incorporated herein by reference.

What is claimed is:

1. An electrical cable connector comprising:

a plurality of contacts, which are aligned and retained in a retaining member made of an electrically insulative material, each of said contacts including a cable connection portion with an upper surface, onto which a core wire of each cable is soldered;

wherein:

said retaining member includes a plurality of grooves having top surfaces which are aligned in a common plane, said grooves having respective receiving portions, to receive, align and retain the respective cable connection portions of said contacts, respectively, abutting respective bottoms of respective receiving portions; and when the cable connection portions of said contacts are received and retained in said receiving portions, and when said core wires are mounted on the upper surfaces of said cable connection portions, respectively, upper ends of said core wires are positioned evenly above the top surfaces of the grooves and the upper surfaces of said cable connection portions are positioned below the top surfaces of the grooves in which said receiving portions are provided.

2. The electrical cable connector set forth in claim 1 wherein:

all of said receiving portions are of constant depth have an identical depth which is greater than a thickness of the cable connection portions; and when said cable connection portions are received and retained in said receiving portions of constant depth, the upper surfaces of said cable connection portions are positioned below the plane in which said receiving portions of constant depth are provided, so that said core wires are placed respectively in concaves which are defined by sides of said receiving portions of constant depth and the upper surfaces of said cable connection portions.

3. The electrical cable connector set forth in claim 2 wherein:

said cable is a coaxial cable comprising a core wire, an inner insulating layer, which covers said core wire, an electrically conductive shielding layer, which covers said inner insulating layer, and an outer insulating layer, which covers said electrically conductive shielding layer;

a plurality of said coaxial cables are stripped of said outer insulating layers to expose said electrically conductive shielding layers and are aligned to one another, so that a plurality of said coaxial cables can be aligned and retained in a plane by sandwiching said electrically conductive shielding layers with two electrically conductive binding plates; and said core wires, which are aligned and are exposed at end portions of said cables beyond portions that are sandwiched by said electrically conductive binding plates, are placed and then soldered in a single soldering step onto the upper surfaces of said cable connection portions, which are received and retained in said portions of constant depth.

4. The electrical cable connector set forth in claim 3 wherein:

portions of said cables between portions where said core wires are exposed and the portions which are sandwiched by said electrically conductive binding plates are stripped of said outer insulating layers and said electrically conductive shielding layers to expose said inner insulating layers; and the portions of said cables where said inner insulating layers are exposed are bent in a U or V shape to provide slack.

5. The electrical cable connector set forth in claim 3, further comprising a metallic cover, which covers said retaining member aligning and retaining said contacts and said electrically conductive binding plates aligning and retaining said coaxial cables soldered to said cable connection portions; wherein:

said electrically conductive binding plates are maintained in contact with said metallic cover.

6. The electrical cable connector set forth in claim 5 wherein:

when said cable connector is engaged with an matable connector, said metallic cover comes into contact with a grounding member of said matable connector, establishing an electrical grounding connection.

7. The electrical cable connector set forth in claim 4, further comprising a metallic cover, which covers said retaining member aligning and retaining said contacts and said electrically conductive binding plates aligning and retaining said coaxial cables soldered to said cable connection portions; wherein, said electrically conductive binding plates are maintained in contact with said metallic cover.

8. The electrical cable connector set forth in claim 7, wherein:

when said cable connector is engaged with a matable connector, said metallic cover comes into contact with a grounding member of said matable connector, establishing an electrical grounding connection.

9. An electrical cable connector comprising:

a plurality of contacts, which are aligned and retained in a retaining member made of an electrically insulative material, each of said contacts including a cable connection portion with an upper surface, onto which a core wire of each cable is soldered;

wherein:

said retaining member includes a plurality of grooves having top surfaces which are aligned in a common plane, said grooves having respective receiving as portions, which receive, align and retain the cable connection portions of said contacts, respectively, with said cable connection portions abutting respective bottoms of respective receiving portions; the core wires on the upper surfaces of the cable connection portions, respectively, having upper ends positioned evenly above the top surfaces of said grooves in which said receiving portions are provided so that the respective upper ends of respective core wires protrude above respective receiving portions.

10. An electrical cable connector as set forth in claim 9 wherein the core wires have respective lower ends received in respective portions of constant depth.

11. An electrical cable connector as set forth in claim 9 or 10 wherein the contacts are flat.

* * * * *